US005214986A

United States Patent [19]

Roberts

[11] Patent Number: 5,214,986

[45] Date of Patent: Jun. 1, 1993

[54] QUICK RELEASE MECHANISM FOR TOOLS SUCH AS SOCKET WRENCHES

[76] Inventor: Peter M. Roberts, P.O. Box 15762, Red Bank, Tenn. 37415

[21] Appl. No.: 767,266

[22] Filed: Sep. 27, 1991

[51] Int. Cl.[5] ..... B25B 13/00

[52] U.S. Cl. ..... 81/177.85; 403/20; 81/177.2

[58] Field of Search ..... 81/60–63.2, 81/177.1, 177.2, 177.85; 403/20; 285/385

[56] References Cited

U.S. PATENT DOCUMENTS

| | | | |
|---|---|---|---|
| 1,569,117 | 1/1926 | Carpenter . | |
| 1,660,989 | 2/1928 | Carpenter . | |
| 1,775,402 | 9/1930 | Mandl . | |
| 1,864,466 | 6/1932 | Peterson . | |
| 2,072,463 | 3/1937 | Mims | 81/125 |
| 2,108,866 | 2/1938 | Mandl | 287/119 |
| 2,290,215 | 7/1942 | Stenberg | 287/53 |
| 2,721,090 | 10/1955 | Kaman | 287/119 |
| 2,736,562 | 2/1956 | Blackburn | 279/76 |
| 3,011,794 | 12/1961 | Vaughn | 279/76 |
| 3,018,866 | 1/1962 | Elliott et al. | 192/150 |
| 3,069,945 | 12/1962 | Shandel | 81/53 |
| 3,094,344 | 6/1963 | Varga | 287/52.08 |
| 3,156,479 | 11/1964 | Drazick | 279/76 |
| 3,167,338 | 1/1965 | Troike | 287/119 |
| 3,208,318 | 9/1965 | Roberts | 81/177 |
| 3,515,399 | 6/1970 | Wordsworth | 279/93 |
| 3,613,221 | 10/1971 | Pronk | 29/526 |
| 3,777,596 | 12/1973 | Smyers et al. | 81/177.85 |
| 3,822,074 | 7/1974 | Welcker | 285/305 |
| 3,890,051 | 6/1975 | Biek | 403/20 |
| 4,367,663 | 1/1983 | Merics | 81/177 A |
| 4,399,722 | 8/1983 | Sardo, Jr. | 81/60 |
| 4,420,995 | 12/1983 | Roberts | 81/60 |
| 4,480,511 | 11/1984 | Nickipuck | 81/177 G |
| 4,508,005 | 4/1985 | Herman et al. | 81/177.85 |
| 4,571,113 | 2/1986 | Coren | 81/177.85 X |
| 4,848,196 | 7/1989 | Roberts | 81/177.85 |

FOREIGN PATENT DOCUMENTS

| | | |
|---|---|---|
| 0066710 | 12/1982 | European Pat. Off. . |
| 2121316 | 9/1972 | Fed. Rep. of Germany . |
| 847209 | 10/1939 | France . |

*Primary Examiner*—James G. Smith

*Attorney, Agent, or Firm*—Willian Brinks Olds Hofer Gilson & Lione

[57] ABSTRACT

A tool of the type having a drive stud for receiving and releasing a tool attachment includes an opening in the drive stud and a locking pin movably mounted in the opening. The opening defines upper and lower ends, and the lower end of the opening is located at a portion of the drive stud constructed for insertion into the tool attachment. The lower end of the locking member is constructed to engage the tool attachment when the locking member is positioned in an engaging position and to release the tool attachment when the locking member is moved to a release position. An actuating member is movably positioned on the drive stud, and a flexible tension member is secured between the actuating member and the locking pin and extends through the upper end of the opening such that movement of the actuating member causes the locking pin to move from the engaging to the release positions.

23 Claims, 2 Drawing Sheets

QUICK RELEASE MECHANISM FOR TOOLS SUCH AS SOCKET WRENCHES

BACKGROUND OF THE INVENTION

This invention relates to torque transmitting tools of the type having a drive stud shaped to receive and release a tool attachment, and in particular to an improved quick release mechanism for securing and releasing a tool attachment to and releasing it from the drive stud.

My previous U.S. Pat. No. 4,848,196 discloses several quick release mechanisms for securing tool attachments such as sockets to torque transmitting tools such as wrenches. In these mechanisms the tool includes a drive stud which defines a diagonally oriented opening, and a locking pin is positioned within the opening so as to move in the opening. In its engaging position, the lower end of the locking pin engages a recess in the socket so as to lock the socket positively in place on the drive stud. When the operator moves the pin in the opening, the lower end of the pin is moved out of contact with the socket, and the socket is released from the drive stud.

In the mechanism shown in FIGS. 1 through 5 of U.S. Pat. No. 4,848,196, the locking pin is held in place by an extension spring which surrounds the shaft of the drive stud. In the version shown in FIGS. 20 through 24, the position of the locking pin is controlled by a collar positioned around the drive stud, which collar is mounted to tilt between first and second positions in which the lower end of the locking pin engages and disengages the socket, respectively.

SUMMARY OF THE INVENTION

It is an object of this invention to provide an improved quick release mechanism which is simple in construction; which requires only a few, easily manufactured parts; which is rugged and reliable in use; which automatically accommodates various sockets, including those with and without recesses designed to receive a detent; which substantially eliminates any precise alignment requirements; and which is low in profile.

This invention represents an improvement in a tool of the type comprising a drive stud for receiving and releasing a tool attachment; wherein the drive stud has an opening therein; wherein a locking member is movably disposed in the opening; wherein the opening defines upper and lower ends, the lower end of the opening being located at a portion of the drive stud constructed for insertion into the tool attachment; and wherein the lower end of the locking member is constructed to engage the tool attachment when the locking member is positioned in an engaging position and to release the tool attachment from the drive stud when the locking member is moved to a release position.

According to the present invention, an actuating member is movably positioned on the drive stud, and a flexible tension member such as a flexible cable or strap is secured between the actuating member and the locking member to extend through the upper end of the opening such that movement of the actuating member moves the locking member from the engaging position to the release position.

Because the actuating member is coupled to the locking member via the tension member, and because the tension member is itself flexible, precise alignment is not required between the actuating member and the locking member. Rather, the flexibility of the tension member automatically compensates for any misalignment to a large degree. For this reason, the manufacturing tolerances required for the various components can be relaxed, without creating misalignment problems.

BRIEF DESCRIPTION OF THE DRAWINGS

FIG. 4 illustrates the fact that when one pulls downwardly on the socket while so locked, the pin firmly resists downward movement of the socket and prevents removal of the socket.

DETAILED DESCRIPTION OF THE PRESENTLY PREFERRED EMBODIMENTS

Figure 1:
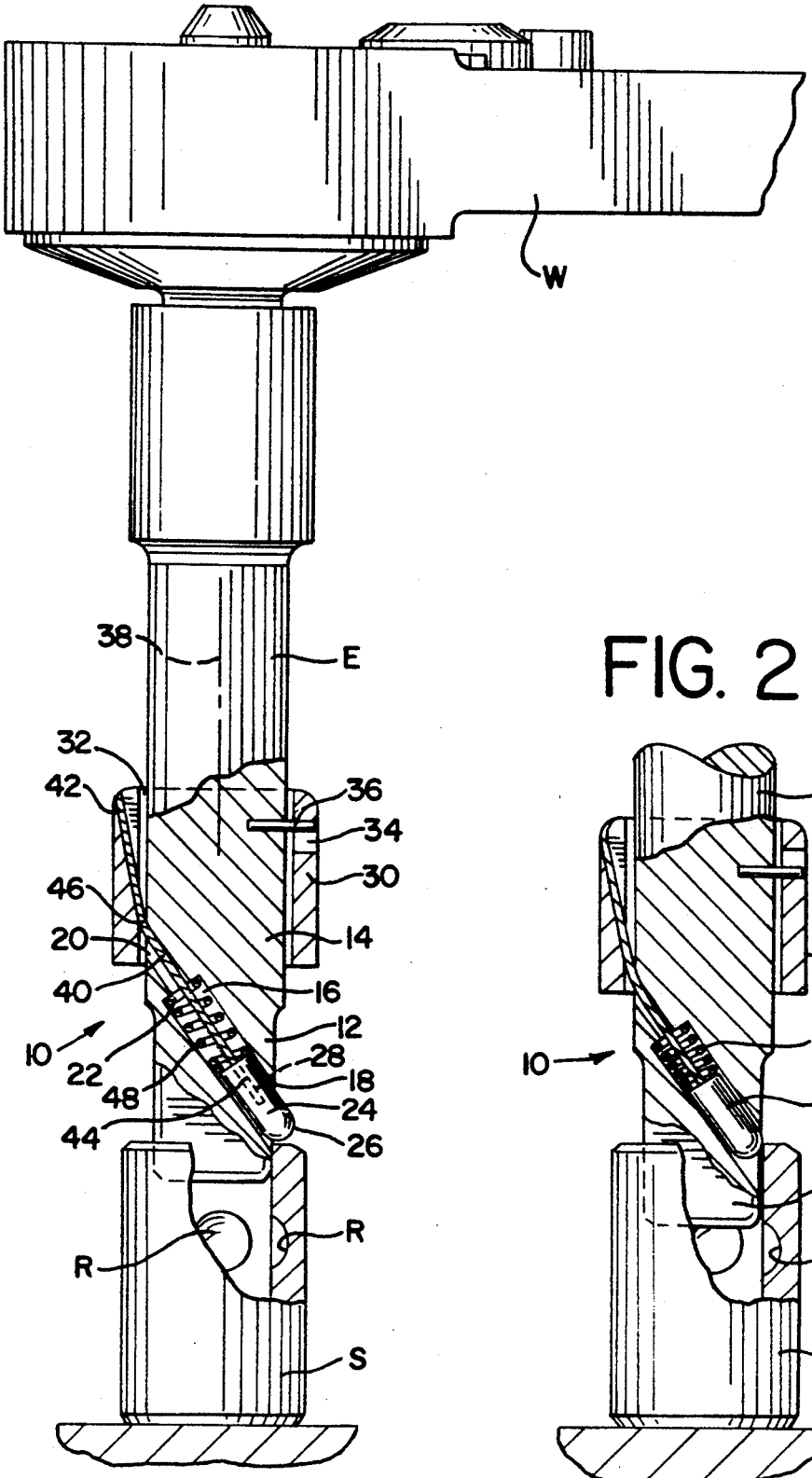
FIG. 1 is a side elevational view partially in cross section of a rachet socket wrench, an extension bar and a socket disposed, for attachment to the lower end of the extension bar and showing the presently preferred embodiment of the quick release mechanism of this invention.

Turning now to the drawings, FIG. 1 shows a side elevational view of a tool which in this preferred embodiment is an extension bar E. As shown in FIG. 1, extension bar E is designed to be mounted on a wrench W and to fit into and transmit torque to a socket S. The extension bar E terminates at its lower end in a drive stud 10 having a lower portion 12 and an upper portion 14. The lower portion 12 is constructed for insertion into the socket S, and defines an out of round cross section. Typically, the lower portion 12 has a square, hexagonal or other non-circular shape in horizontal cross section. The upper portion 14 will often define a circular cross section, though this is not required.

As shown in FIG. 1, the drive stud 10 is configured to define a diagonally positioned opening 16 having a lower end 18 and a upper end 20. The lower end 18 is positioned in the lower portion 12 of the drive stud 10, and the upper end 20 is positioned in the upper portion 14 of the drive stud 10. The opening 16 has a smaller diameter adjacent the upper end 20 than the lower end 18, and the opening 16 defines a transverse step 22 between the larger and smaller diameter portions of the opening 16.

The foregoing features of the wrench W, extension bar E and socket S are substantially as described in connection with FIGS. 20–25 of my previous U.S. Pat.

No. 4,848,196. It may be preferable in some embodiments to provide the opening 16 with a constant diameter, and to define the step 22 in some other manner, as for example with a plug of the type shown in FIG. 20 of my previous U.S. Pat. No. 4,848,196.

As shown in FIG. 1, a locking member such as a pin 24 is slidably positioned in the opening 16. This pin 24 defines a lower end 26 shaped to engage the socket S and a cavity 28. The lower end 26 of the pin 24 may be conventionally rounded, or it may alternately be provided with a step as shown in my previous U.S. Pat. No. 4,848,196. Though illustrated as a pin 24, the locking member may take various shapes, including spherical, irregular and elongated shapes. If desired, the pin 24 may be provided with an out of round cross section and the opening 16 may define a complimentary shape such that a preferred rotational position of the pin 24 in the opening 16 is automatically obtained.

Also as shown in FIG. 1, an actuation member such as a collar 30 is positioned around the upper portion 14 of the drive stud 10. This collar 30 defines a groove 32 and a slot 34. In this embodiment the groove 32 and the slot 34 are parallel and positioned on diametrically opposed sides of the collar 30. A pin 36 such as a roll pin is secured to the upper portion 14 of the drive stud 10 to fit within the slot 34. The slot 34 is preferably substantially longer than it is wide such that the pin 36 and the slot 34 cooperate to prevent rotation of the collar 30 on the drive stud 10 while allowing the collar 30 to translate along a sliding axis 38 through a selected range. Of course, it is possible to reverse the arrangement and to place a slot in the drive stud 10 and a pin in the collar 30. Furthermore, the pin 36 does not have to be a separate element, and it can be integrally formed in either the collar 30 or the drive stud 10. Similarly, the slot 34 can be formed either as a through opening or a groove, and the slot 34 is not necessarily positioned opposite the groove 32. Also the groove 32 may be formed in the drive stud 10.

Though the actuation member is shown as a collar 30 that slides along the sliding axis 38, an alternate embodiment of the actuating member may be formed as a slide that does not encircle the drive stud 10, or as an operating element (whether encircling the drive stud 10 or not) which is operated by a rocking or tilting movement on the drive stud rather than by a translational movement.

A flexible tension member such as a strap or cable 40 is secured between the collar 30 and the locking pin 24. The cable 40 defines a first end 42 which is secured to the collar 30 and a second end 44 which is secured in the cavity 28 of the locking pin 24. As shown in FIG. 1, the cable 40 is received in the groove 32, and the cable 40 defines a bend 46 adjacent to the upper end 20 of the opening 16. Because the sliding axis 38 is positioned obliquely with respect to the opening 16, there is a possibility for misalignment between the collar 30 and the pin 24. The cable 40 substantially reduces any misalignment problems, because the flexibility of the cable 40 allows it to bend as shown at 46.

The flexible tension member may take many forms, including that of a wire, chain, braided wire, twisted wire, line, or strap. For example, a suitable high strength polymer can be used to form a line or strap having a round, rectangular, or even asymmetric cross section. If suitably torsionally rigid, the tension member may itself define a preferred rotational position for the pin 24 in the opening 16.

A spring such as a coil spring 48 biases the pin 24 to the engaging position shown in FIG. 1. As shown, the spring 48 is an extension spring which bears between the step 22 and the locking pin 24, with the cable 40 passing through the spring 48. In alternate embodiments the spring may be implemented in other forms, as for example by means of a leaf spring. Furthermore, if a coil spring is used, it may be employed as either a compression or an expansion spring with suitable alterations to the design of FIG. 1, and the spring may be eliminated in some embodiments.

This invention can be adapted for use with the widest range of torque transmitting tools, including hand tools, power tools and impact tools. Simply by way of illustration, this invention can be used with socket wrenches, including those having ratchets, T bar wrenches, and speeder wrenches, all as described and shown in my previous U.S. Pat. No. 4,848,196. Furthermore, this invention is not limited to sockets of the type shown, but can be used with a wide range of tool attachments, including sockets or tool attachments with varying sized recesses R and even on sockets without a recess of any type.

The operation of the quick release mechanism described above will be apparent from FIGS. 1 through 5. As shown in FIG. 1, when the lower portion 12 of the drive stud 10 is brought into alignment with the socket S, the lower end 26 of the locking pin 24 bears on the socket S.

Figure 2:
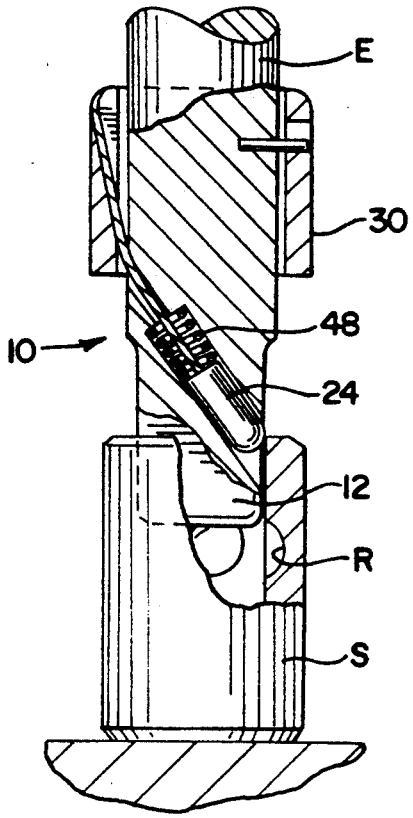
FIG. 2 is a fragmentary side elevational view of the extension bar and the associated socket of FIG. 1 but showing the drive stud of the extension bar partially moved downwardly into the socket and with the locking pin cammed upwardly to allow further downward movement of the drive stud.

As shown in FIG. 2, further downward movement of the drive stud 10 moves the pin 24 upwardly and inwardly in the opening 16, thereby allowing the lower portion 12 to move within the socket S. This can be done without manipulating the collar 30 in any way.

Figure 3:
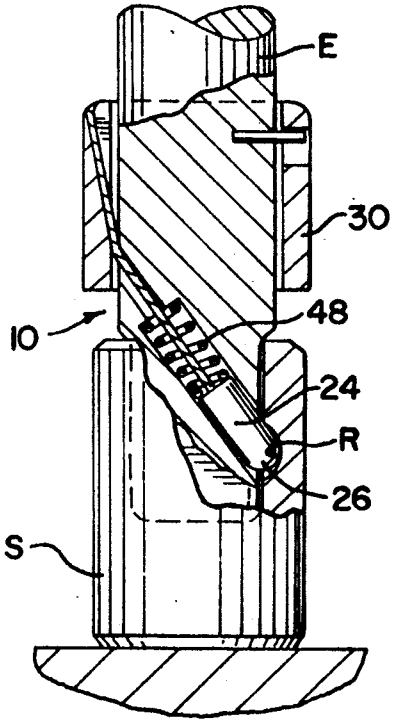
FIG. 3 is a view similar to FIG. 2 showing the drive stud of the extension bar moved downwardly into its final position in the socket with the locking pin restored to its maximum downward position with its lower end projecting into the recess provided in the inner surface of the socket.

As shown in FIG. 3, when the drive stud 10 is fully seated in the socket S, the spring 48 returns the locking pin 24 to the engaging position, in which the lower end 26 of the locking pin 24 engages the recess R in the socket S. The pin 24 will provide at least frictional engagement, even with a socket S which does not include a recess R.

Figure 4:
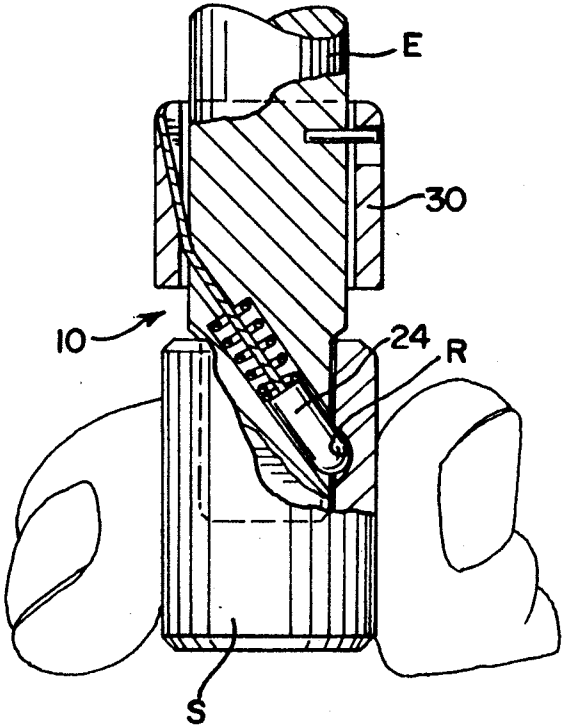
FIG. 4 is a view similar to FIG. 3 showing the relationship of the parts when the socket is positively locked on the drive stud of the extension bar.

As shown in FIG. 4, downward forces on the socket S are not effective to move the locking pin 24 out of its engaging position, and the socket S is positively held in place on the drive stud 10.

Figure 5:
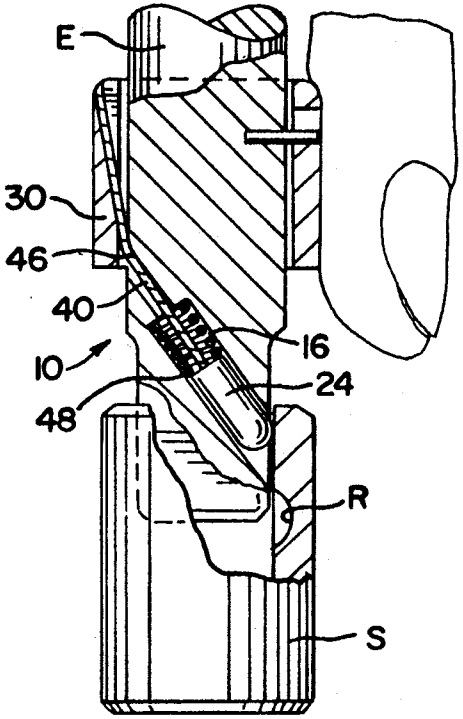
FIG. 5 is a view similar to FIG. 3 but showing that the operator can effect a quick release of the socket by manually lifting the collar surrounding the drive stud and allowing the socket to drop from the drive stud by force of gravity.

As shown in FIG. 5, the collar 30 is raised to release the socket S. This causes the cable 40 to move the locking pin 24 to a release position in the opening 16 by compressing the spring 48. During this movement the bend 46 travels along a section of the length of the cable 40 and ensures a smooth action, even in the event of a slight misalignment between the collar 30 and the pin 24. When the locking pin 24 reaches the release position the socket S is free to fall from the drive stud 10 under the force of gravity.

Of course, the quick release mechanism of this invention can be used in any physical orientation, and the terms upper, lower and the like have been used with reference to the orientation shown in the drawings. Furthermore, the terms "engaging position" and "release position" are each intended to encompass multiple positions within a selected range. For example, in the embodiment of FIG. 1 the exact position of the engaging position will vary with the depth of the recess R in the socket S, and the exact position of the release position may vary with a variety of factors, including the extent to which the actuating member is moved.

As suggested above, the present invention can be implemented in many ways, and this invention is not limited to the specific embodiment shown in the drawings. However, in order to define the presently preferred embodiment of this invention the following presently preferred details of construction are provided. These details are of course in no way intended to limit the scope of this invention.

By way of example, the pin 24 may be formed of a material such as a steel of moderate to mild temper, the cable 40 may be a twisted wire cable, and the collar 30 may be formed of any suitable material such as brass, steel, or other alloy. The cable 40 may be secured to the collar 30 by any suitable mechanical, adhesive, welding or soldering technique, but a conventional silver solder process is presently preferred. The cable 40 may be secured to the pin 24 by any suitable mechanical, adhesive, welding or soldering approach, but at present compressive deformation of the pin 24 is preferred.

From the foregoing description it should be apparent that the objects set out initially above have been achieved. In particular, the mechanism shown in the drawings is low profile with respect to the circumference of the extension bar E, and the cable 40 and particularly the flexibility of the cable 40 in the region of the bend 46 reduce any alignment problems. The disclosed mechanism is simple to manufacture and assemble and requires relatively few parts. It is rugged in operation, and it automatically engages a socket as described above. Because of its design, the mechanism will accommodate various types of sockets, including sockets with various types of recesses or no recess at all. In the illustrated embodiment, the collar 40 may be gripped at any point on its circumference, and does not require the operator to use a preferred angular orientation of the tool.

In the illustrated embodiment the locking member slides in the diagonal opening of the drive stud. Alternatively, the locking member may be mounted to rotate or to pivot in the drive stud in a manner similar to the embodiments of FIGS. 12–15 of my U.S. Pat. No. 4,848,196. In some alternate embodiments, the locking member may be configured to require a positive action on the part of the operator to retract the locking member as the drive stud is moved into the socket. Certain of these embodiments may require recesses in the sockets as described above to provide all of the functional advantages described.

It is intended that the foregoing detailed description be regarded as illustrative rather than limiting, and that it be understood that it is the following claims, including all equivalents, which are intended to define the scope of this invention.

I claim:

1. In a tool comprising a drive stud for receiving and releasing a tool attachment; said drive stud having an opening therein and a locking member movably disposed in said opening; said opening defining upper and lower ends, the lower end of said opening being located at a portion of said drive stud constructed for insertion into said tool attachment; the lower end of said locking member being constructed to engage said tool attachment when said locking member is positioned in an engaging position and to release said tool attachment from said drive stud when said locking member is moved to a release position; the improvement comprising:

an actuating member movably positioned on said drive stud;

a flexible tension member secured between said actuating member and said locking member and extending through the upper end of said opening such that movement of said actuating member pulls said tension member through the opening, and the tension member in turn pulls said locking member from the engaging position to the release position.

2. The invention of claim 1 wherein said opening is diagonally disposed in said drive stud; wherein the upper end of said opening is externally open above that portion of said drive stud constructed for insertion into said tool attachment; and wherein said actuating member extends above that portion of said drive stud constructed for insertion into said tool attachment, for receiving manually applied forces from an operator to move said locking member repetitively between said release and engaging positions.

3. The invention of claim 1 or 2 further comprising a spring operative to bias said locking member to the engaging position.

4. The invention of claim 3 wherein said spring comprises a coil spring disposed in said opening, and wherein said tension member passes through said coil spring.

5. The invention of claim 1 or 2 wherein said tension member comprises a cable.

6. The invention of claim 1 or 2 wherein said tension member comprises a cable which defines a first end secured to said actuating member, a second end secured to said locking member, and a bend intermediate said first and second ends, said bend positioned adjacent to the upper end of said opening.

7. The invention of claim 1 or 2 wherein said locking member defines a cavity which receives an end of the tension member.

8. The invention of claim 7 wherein said locking member is compressively deformed to secure said end to said locking member.

9. The invention of claim 1 or 2 further comprising means for restricting rotation of said actuating member on said drive stud while allowing translation of said actuating member within a selected range.

10. The invention of claim 1 or 2 further comprising:

a slot formed in one of said actuating member and said drive stud; and a protruding member secured to the other of said actuating member and said drive stud to extend into and move along said slot;

said slot oriented to restrict rotation of said actuating member while allowing translation of said actuating member with respect to said drive stud within a selected range.

11. The invention of claim 1 or 2 wherein said actuating member defines a depression sized to receive a portion of said tension member.

12. The invention of claim 1 or 2 wherein said actuating member is positioned on said drive stud and guided for sliding motion with respect to said drive stud along a sliding axis oriented obliquely with respect to said opening.

13. The invention of claim 12 further comprising means for restricting rotation of said actuating member on said drive stud while allowing translation of said actuating member within a selected range.

14. The invention of claim 12 further comprising:

a slot formed in one of said actuating member and said drive stud; and a protruding member secured to the other of said actuating member and said drive stud to extend into and move along said slot;

said slot oriented to restrict rotation of said actuating member while allowing translation of said actuating member with respect to said drive stud within a selected range.

15. The invention of claim 12 wherein said actuating member defines a depression sized to receive a portion of said tension member.

16. The invention of claim 12 wherein said actuating element comprises a collar positioned around said drive stud.

17. In a tool comprising a drive stud for receiving and releasing a tool attachment; said drive stud having an opening therein and a locking member movably disposed in said opening; said opening defining upper and lower ends, the lower end of said opening being located at a portion of said drive stud constructed or insertion into said tool attachment; the lower end of said locking member being constructed to engage said tool attachment when said locking member is positioned in an engaging position and to release said tool attachment from said drive stud when said locking member is moved to a release position; the improvement comprising:

an actuating member movably positioned on said drive stud;

a flexible tension member secued between said actuating member and said locking member and extending through the upper end of said opening such that movement of said actuating member causes said locking member to move from the engaging position to the release position;

wherein said opening is diagonally disposed in said drive stud; wherein the upper end of said opening is externally open above that portion of said drive stud constructed for insertion into said tool attachment; and wherein said actuating member extends above that portion of said drive stud constructed for insertion into said tool attachment, for receiving manually applied forces from an operator to move said locking member repetitively between said release and engaging positions; and a spring operative to bias said locking member to the engaging position.

18. The invention of claim 17 wherein said spring comprises a coil spring disposed in said opening, and wherein said tension member passes through said coil spring.

19. In a tool comprising a drive stud for receiving and releasing a tool attachment; said drive stud having an opening therein and a locking member movably disposed in said opening; said opening defining upper and lower ends, the lower end of said opening being located at a portion of said drive stud constructed for insertion into said tool attachment; the lower end of said locking member being constructed to engage said tool attachment when said locking member is positioned in an engaging position and to release said tool attachment from said drive stud when said locking member is moved to a release position; the improvement comprising:

an actuating member movably positioned on said drive stud;

a flexible tension member secured between said actuating member and said locking member and extending through the upper end of said opening such that movement of said actuating member causes said locking member to move from the engaging position to the release position;

wherein said tension member comprises a cable.

20. In a tool comprising a drive stud for receiving and releasing a tool attachment; said drive stud having an opening therein and a locking member movably disposed in said opening; said opening defining upper and lower ends, the lower end of said opening being located at a portion of said derive stud constructed for insertion into said tool attachment; the lower end of said locking member being constructed to engage said tool attachment when said locking member is positioned in an engaging position and to release said tool attachment from said drive stud when said locking member is moved to a release position; the improvement comprising:

an actuating member movably positioned on said drive stud;

a flexible extension member secured between said actuating member and said locking member and extending through the upper end of said opening such that movement of said actuating member causes said locking member to move from the engaging position to the release position;

wherein said tension member comprises a cable which defines a first end secured to said actuating member, a second end secured to said locking member, and a bend intermediate said first and second ends, said bend positioned adjacent to the upper end of said opening.

21. In a tool comprising a drive stud for receiving and releasing a tool attachment; said drive stud having an opening herein and a locking member movably disposed in said opening; said opening defining upper and lower ends, the lower end of said opening being located at a portion of said drive stud constructed for insertion into said tool attachment; the lower end of said locking member being constructed to engage said tool attachment when said locking member is positioned in an engaging position and to release said tool attachment from said drive stud when said locking member is moved to a release position; the improvement comprising:

an actuating member movably positioned on said drive stud;

a flexible tension member secured between said actuating member and said locking member and extending through the upper end of said opening such that movement of said actuating member causes said locking member to move from the engaging position to the release position;

wherein said locking member defines a cavity which receives an end of the tension member.

22. The invention of claim 21 wherein said locking member is compressively deformed to secure said end to said locking member.

23. The invention of claim 19, 20 or 21 wherein said opening is diagonally disposed in said drive stud; wherein the upper end of said opening is eternally open above that portion of said drive stud constructed for insertion into said tool attachment; and wherein said actuating member extends above that portion of said drive stud constructed for insertion in said tool attachment, for receiving manually applied forces form an operator to move said locking member repetitively between said release and engaging positions.

* * * * *

UNITED STATES PATENT AND TRADEMARK OFFICE

CERTIFICATE OF CORRECTION

PATENT NO. : 5,214,986
DATED : June 1, 1993
INVENTOR(S) : Peter M. Roberts

It is certified that error appears in the above-indentified patent and that said Letters Patent is hereby corrected as shown below:

In column 2, line 10, after "disposed" delete ",".

IN THE CLAIMS

In column 8, line 6, delete "derive" and substitute therefor --drive--; line 21, delete "extension" and substitute therefor --tension--.

In column 8, line 34, delete "herein" and substitute therefor --therein--.

In column 8, line 60, delete "eternally" and substitute therefor --externally--; line 64, after "insertion" delete "in" and substitute therefor --into--; line 65, delete "form" and substitute therefor --from--.

Signed and Sealed this

Fourteenth Day of June, 1994

Bruce Lehman

*Attest:*

BRUCE LEHMAN

*Attesting Officer*

*Commissioner of Patents and Trademarks*